US005701150A

United States Patent [19]

Horemans et al.

[11] Patent Number: 5,701,150

[45] Date of Patent: Dec. 23, 1997

[54] THERMAL DYE TRANSFER PRINTING PROCESS FOR REDUCING CURLING OF A PRINT SHEET

[75] Inventors: Luc Horemans, Aartselaar; Eric Kaerts, Melsele, both of Belgium

[73] Assignee: Agfa-Gevaert N.V., Mortsel, Belgium

[21] Appl. No.: 399,746

[22] Filed: Mar. 7, 1995

[30] Foreign Application Priority Data

Apr. 29, 1994 [EP] European Pat. Off. ..... 94201178

[51] Int. Cl.[6] ..... B41J 2/32

[52] U.S. Cl. ..... 347/212

[58] Field of Search ..... 347/212; 400/120.18

[56] References Cited

U.S. PATENT DOCUMENTS

| | | | |
|---|---|---|---|
| 4,966,464 | 10/1990 | Matoushek | 347/212 |
| 4,972,206 | 11/1990 | Matoushek | 347/212 |
| 5,113,201 | 5/1992 | Mano et al. . | |

OTHER PUBLICATIONS

Patent Abstracts of Japan, vol. 8, No. 174, abstract of JP-A-59067065 (Apr. 16, 1984).

Patent Abstracts of Japan, vol. 14, No. 196, abstract of JP-A-02039056 (Feb. 7, 1990).

Patent Abstracts of Japan, vol. 12, No. 97, abstract of JP-A-62231281 (Oct. 9, 1987).

Patent Abstracts of Japan, vol. 8, No. 203, abstract of JP-A-59093319 (May 29, 1984).

Patent Abstracts of Japan, vol. 11, No. 221, abstract of JP-A-62037185 (Feb. 18, 1987).

*Primary Examiner*—Huan H. Tran

*Attorney, Agent, or Firm*—Brumbaugh, Graves, Donohue & Raymond

[57] ABSTRACT

A thermal dye transfer printing process for making transparent prints, which comprises bringing a dye-bearing donor ribbon (17) in contact with a dye-receiving polymer print sheet (15) at a print zone, supporting both materials on a backing support (14) in said zone and contacting the donor ribbon with a print head (18) for image-wise heating the ribbon and cause dye transfer to the print sheet, wherein the rear side of the print sheet is uniformly heated on a drum (30) after removal of the sheet from the backing support, thereby to reduce curling of the sheet caused by the image-wise heating of its front side.

2 Claims, 1 Drawing Sheet

THERMAL DYE TRANSFER PRINTING PROCESS FOR REDUCING CURLING OF A PRINT SHEET

BACKGROUND OF THE INVENTION

1. Field of the Invention

The present invention relates to a thermal dye transfer image-printing process which uses a thermal print head.

2. Description of the Prior Art

In the thermal dye transfer printing process, a dye-bearing donor ribbon is brought into contact with a dye-receiving print sheet at a print zone. Thermal printing is effected by contacting the donor ribbon with a multi-element print head which spans the ribbon in a direction transverse to the direction of ribbon travel. The print head typically comprises a linear array of closely spaced resistive heating elements, each being independently addressable by an applied voltage to heat that portion of the donor ribbon directly opposite and thereby cause dye to be transferred from the ribbon to the print sheet in an amount which is proportional to the amount of energizing of the heating elements. The print sheet is beared on the surface of a rotatable print drum which advances the print sheet past the print head.

The printing process described hereinbefore can be used for producing opaque as well as transparent prints. The former are prints on white or coloured paper that are intended for direct reading, whereas the latter can be so-called overhead projection prints for optical projection on a screen, or transparencies for medical diagnosis on a light box, e.g. prints of echographic (ultrasound) or NMR (nuclear magenetic resonance) examinations of a patient.

In the case of prints for medical diagnosis purposes, the support of the print usually is poly(ethylene terephthalate) in a thickness ranging between 0.10 and 0.20 mm. We have found that use of this kind of support raises problems with respect to curling, since a finished print from a thermal printing process has a tendency to curl concavely at its image side. We have measured curl values ranging from 20 to 40 mm for a sheet format of 203.2×254.0 mm, depending on the image data. The measurements occurred by putting the print sheet with its convex rear side on a table top and then measuring the distance the four corners were remote of the supporting surface. The mentioned values are the maximum values for a given sheet.

The described curling effect is particularly disturbing since medical X-ray films are usually examined while hanging vertically in front of a light box, a position wherein gravity does not help to flatten the sheet unlike overhead printers where a transparency lies horizontally and usually is also thinner.

SUMMARY OF THE INVENTION

Object of the Invention

It is the object of the present invention to provide an improved thermal printing process for making transparent prints, which causes less curl of the finished print.

Statement of the Invention.

In accordance with the present invention, a thermal dye transfer printing process for making transparent prints which comprises bringing a dye-bearing donor ribbon in contact with a dye-receiving polymer print sheet at a print zone, supporting both materials on a backing support in said zone and contacting the donor ribbon with a print head which spans the ribbon and comprises a multiplicity of closely spaced resistive heating elements for image-wise heating the ribbon and cause dye transfer to the print sheet, is characterised thereby that said process comprises the step of heating the rear side (i.e. the side opposite to the dye-receiving side) of the print sheet thereby to reduce curling of the sheet caused by the image-wise heating of its front side by the print head.

Heating of the rear side of the sheet may occur while the print sheet is still on the backing support, or after removal of the sheet from such support. The latter technique is preferred for two reasons. First, heating of the backing support, e.g. by incorporation of an electric heating element in the print drum, complicates the construction of the apparatus at a critical location, and also raises a problem of overall heat control of the thermal print head closely adjacent thereto. Second, heating the sheet after its removal from the print drum allows an easy and instant adjustment of said heating as will be explained hereinafter.

It should be noted that in many cases the process according to the invention does not reduce the curling of the print sheet to zero. As a matter of fact, curling of the print sheet depends on the amount of heating of its front side and also on the distribution of said heating over the sheet surface. Or in other words, the curling depends on the average surface of the sheet which has been printed and the distribution of said surface over the sheet. Since printing in this type of apparatus is based on digital image-processing, it is clear that it is easy to evaluate the average heating of the sheet. Thus, in practice the heating of the rear side of the sheet may be set in accordance with an average heating of the front side of the sheet caused by printing. As the heating of a printed sheet deviates by a certain degree from such average value, the heating of the rear side of the sheet can be adjusted accordingly. Such adjustment can in one way occur by appropriate temperature control of the heating means for performing such rear side heating. However, the thermal response of such heating system usually is rather slow, and therefore it is of advantage to adjust the speed of the print sheet past such heating system.

Although the process according to the invention does not allow a complete compensation of the curling tendency of a print sheet, a reduction of curling to a value smaller than 10 mm is easily possible. This is considered to be acceptable in the practice of medical X-raying as mentioned hereinbefore.

It should further be mentioned that curling of a print sheet does not necessarily occur in accordance with the axis of the print drum. As a matter of fact we have found that, depending on the pressure of the print head, the degree of print-heating and the basic structure of the print sheet, the print sheet can curl either in the transverse or longitudinal direction of the printer. The process according to the invention is effective in reducing both types of curling.

The process according to the invention differs from the after-treatment known in the art as fusing for sealing and stabilizing the dyes of images obtained by thermal transfer printing. Such-like fusing process can be carried out by means of a cylindrical fuser drum and rollers located around the periphery of the fuser drum for defining nips between which a print sheet is passed while in contact with its rear side with the drum, as disclosed in WO 91/09740. The described process is required in those instances where the stability of the dye image on the print sheet is unsufficient for daylight purposes, e.g. color prints stuck on the wall of an office room. In the application mentioned hereinbefore, namely use of the print sheets for medical diagnosis, dark-room stability only should be considered since the prints are exposed to light for examination purposes only, and otherwise are archived in the dark. In these circumstances fusing as after-treatment is completely superfluous.

The process according to the invention also differs from the after treatment known in the art as fixing an ink image which has been obtained by image-wise transfer of a thermal fusible ink from an ink ribbon on a paper web. This process is carried out by means of a heated drum which re-heats the paper web onto which an ink image has been transferred in order that the ink image should become sufficiently impregnated between the fibers of the recording paper and thereby become fixed. This ink transfer process is known in the art as wax transfer printing, and does not allow continuous tone printing as does the thermal dye transfer printing process according to our invention. This latter process is also known as thermo-sublimation printing. Wax transfer printing occurs at temperatures well below 100° C., as distinct from dye transfer printing, and will not cause web curl if the image transfer would occur on a polymer support. The process described hereinbefore is disclosed in JP-A-59 67065.

The following are suitable embodiments of the process according to the invention.

Heating of the rear side of the print sheet occurs by contact with a heated surface. Said heated surface is the peripheral surface of a heated roller.

The print sheet is biased in contact with such heated roller by means of idler rollers having a covering of polytetrafluoroethylene. Said idler rollers are driven at a peripheral speed equal to that of the heated roller.

The speed of the heated roller and of the idler rollers is adjustable, independent from the printing speed, thereby to adjust the rear side heating of a print sheet. Such adjustment can depend on the image contents of the print sheet.

The temperature of the heated roller surface is between 100 and 140° C.

The support of the print sheet is poly(ethylene terephthalate).

BRIEF DESCRIPTION OF THE DRAWINGS

The subsequent detailed description of the preferred embodiments refers to the accompanying drawings wherein.

DETAILED DESCRIPTION OF THE INVENTION

Figure 1:
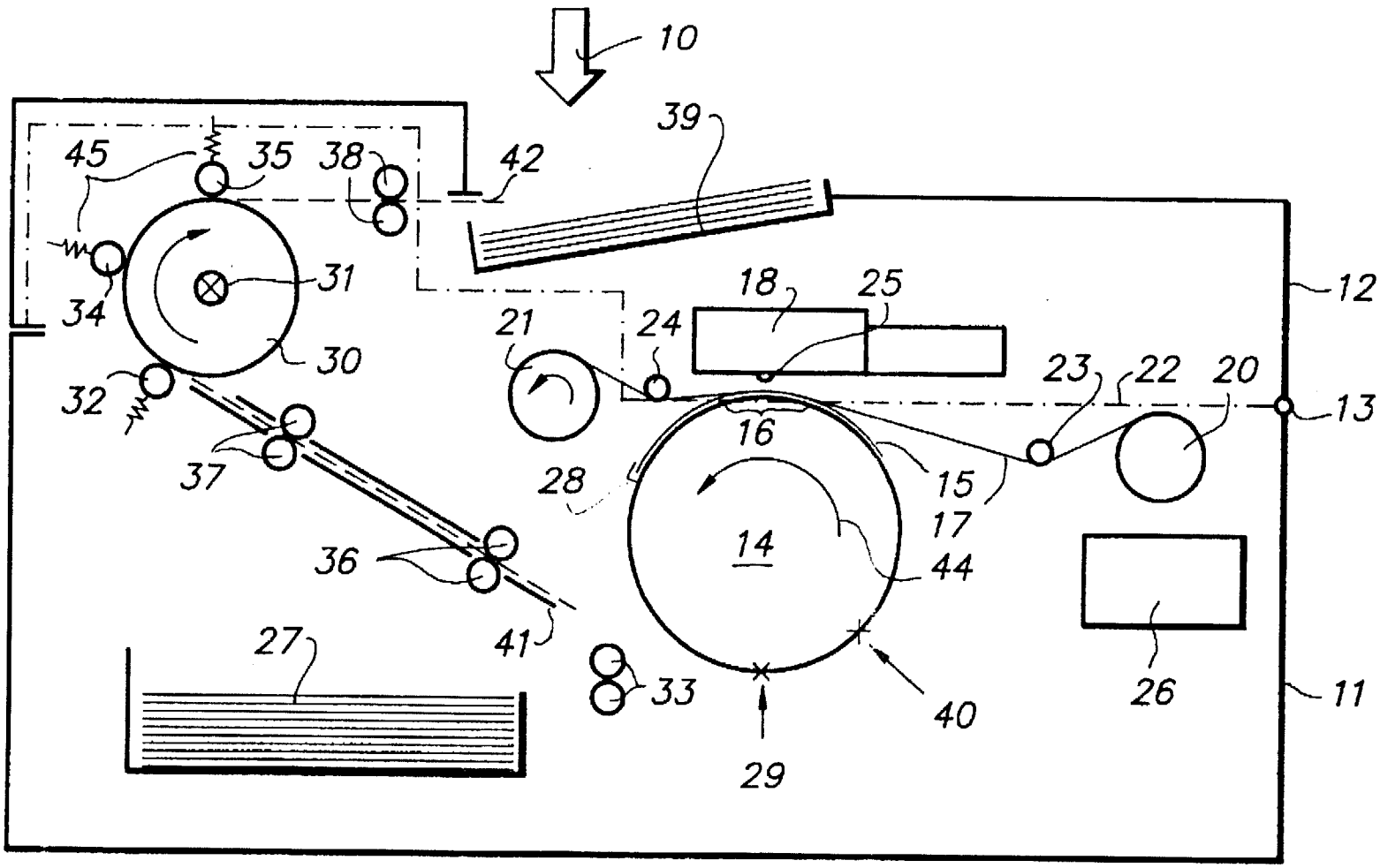
FIG. 1 is a schematic illustration of a thermal transfer printing process.

The invention will be described hereinafter by way of example with reference to the accompanying drawing, which shows one embodiment of an apparatus for carrying out the process according to the invention.

The apparatus is a so-called thermosublimation printer mounted in a housing 10 having a base 11 and a lid 12 hinged thereto at 13, and generally comprises a cylindrical print drum 14, which supports and transports a print-receiving sheet 15 through a print zone 16 where it receives thermally printed information. Dash-and-dot line 22 indicates diagrammatically the lower side of cover 12.

Thermal printing is effected by advancing a dye-bearing donor ribbon 17 through the print zone between the print-receiver sheet 15 and a print head 18. Donor ribbon 17 is fed from a supply spool 20 to a take-up spool 21 driven by suitable motor means. Both spools can be fitted in a cassette for ease of handling, as known in the art, which is located in base 11 of the apparatus. Rollers 23 and 24 controlling the path of the dye-donor ribbon about drum 14 move together with lid 12.

Print head 18 spans the print drum and is of conventional design. It comprises a linear array 25 of closely spaced resistive elements, each being independently addressable with image information by an applied voltage provided by a microprocessor 26 suitably connected thereto. As each resistive element is addressed, it heats that portion of the donor ribbon directly opposite, thereby causing dye to be transferred from the donor ribbon to the print receiver sheet. In colour thermal printers, the donor ribbon usually comprises patches of yellow, magenta, cyan and possibly black dyes in a repeating series, and the print-receiving sheet is rotated correspondingly three or four times through the print zone to receive a full-colour image. A print-receiver sheet is taken from a sheet supply 27 by means known in the art, advanced by a roller pair 33 and clamped with its leading edge on the drum by a clamping mechanism 28, which in the sheet clamping position takes an angular position indicated by cross 29. As the first colour separation image has been printed, printing head 18 is slightly lifted thereby removing the dye ribbon from the print drum and allowing the print drum to rotate idle and pass with its clamp under the print array 25 to locate the print sheet in a correct position for receiving a next colour separation image. During the consecutive printing of the distinct colour separation images, the image side of the print sheet 15 becomes subjected to substantial heating by printing array 18. In the case of print sheets of a type that is disadvantageously influenced by heating, such as biaxially stretched and molecularly oriented poly(ethylene terephthalate) which is a common support for transparent images in photography, tensioning forces arise in the sheet which cause the sheet to curl concavely at its image side after cooling. Contrary to the expectations, we have found that this curling does not always occur in a direction parallel to the printing head, but that it can also occur in a direction normal thereto. We have found that curling of a print sheet measuring 203.2×254.0 mm can attain a maximum value up to 40 mm, and such independently of the fact the sheet was clamped with its long or small side in the clamp of the drum.

The improvement in accordance with the process according to the invention is obtained by means of the following provisions in the apparatus. A heated roller 30 rotatable about a fixed axis and having inside an electrical heating element 31. Three pressure rollers 32, 34 and 35 angularly distributed around heated roller 30 and the shafts of which are spring-biased towards roller 30 as diagrammatically shown by springs 45. Roller 30 has a resilient covering, e.g. a layer of butyl rubber or the like, whereas rollers 32, 34 and 35 have a covering of Teflon (Registered trade name for polytetrafluoroethylene). Roller 30 as well as pressure rollers 32, 34 and 35 have gear couplings through which they are driven. Further, there are feed roller pairs 36, 37 and 38, and a collector tray 39 in the top wall of cover 12.

The operation of the described printer is as follows.

A printed image having been obtained as described hereinbefore, the print drum is stopped with clamp 28 located at a position as indicated by cross 40 whereby the trailing edge of the print sheet, which is not fastened to the drum, moves downward under the influence of gravity and also of the inherent stiffness of the sheet, whereby it comes in contact with the protruding end of lower guide plate 41. Next, the drum is rotated in a direction reverse to that of arrow 44 whereby the sheet is fed to rollers 36 and next via suitable guide plates to rollers 37 rotating at the same transport speed as the print drum. In the meantime clamp 28 has been opened so that the sheet is freely conveyed towards heated roller 30. The transport speed of sheet 15 around heating roller 30 can be set independent from the printing speed of drum 14.

The temperature of roller 30 is such that, taking into account the speed of the sheet, the wrapping angle around the roller, and the average image contents, heating of the rear side of the sheet compensates to a large extent the effect of the front side heating by the print head. Finally, the sheet is fed by rollers 38 through slotlike opening 42 of the cover into collector receptacle 39.

The following example illustrates the present invention without, however, limiting it thereto.

Print sheet: a poly(ethylene terephthalate) foil bearing a suitable subbing layer for the transferred dyes, measuring 203.2×254.0 mm and having a thickness of 0.18 mm;

Print speed of drum 14 =4.5 mm.sec$^{-1}$;

Transport speed past heating roller 30: 3 cm.sec$^{-1}$;

Heating roller:

diameter: 30 mm surface temperature: 120° C.

sheet wrapping angle: 150 angular degrees

Maximum sheet-curling if not processed according to the invention: 40 mm.

Maximum sheet-curling if processed in accordance with the invention: 10 mm.

It will be understood that the process according to the invention is not limited to the described example.

The rear side heating device must not necessarily be located within the printer housing but it can also be separate thereof.

The rear side heating can be performed by several heated surfaces in succession.

The degree of rear side heating can be adjustable, e.g. by varying the surface temperature of heating roller 30, or by changing the transport speed of rollers 30, 32, 34, 35, 36, 37 and 38. This change raises no problems since once the trailing edge of the sheet has been released by clamp 28, its front edge being not yet in contact with roller 30, any transport speed can be imparted to the sheet. This transport speed can depend on a particular print sheet material, on its thickness and/or on the amount of heating of its front side.

The use of the process of the invention is not limited to transparent polymer sheets, and thus opaque sheets such as so-called voided film, e.g. poly(ethylene terephthalat)e comprising a white pigment as described in U.S. Pat. No. 4,780,402 or film comprising discrete particles of a homopolymer or copolymer of ethylene or propylene, or multiply films can be used as well.

More details about improvements in a thermal printer of a type as described hereinbefore can be found in our co-pending patent applications:

EP 0 602 283 A1, filed Dec. 14, 1992 for a mechanism controlling the winding tension of a dye ribbon;

EP 0 613 784 A1, filed Dec. 14, 1992 for a thermal print head mounted in a subhousing thereby to keep cooling air out of the main housing of the printer; and EP 0 593 821 A1, filed Oct. 22, 1992 for a dye ribbon package for use with a thermal printer.

We claim:

1. A thermal printing process for making transparent prints comprising: supporting a printing substrate having a front side and a rear side on a rotatable print drum such that the rear side contacts the rotatable print drum; thermal printing on the front side of the printing substrate by rotating the rotatable print drum at a printing speed while image-wise energizing a thermal print head thereby heating the front side of the printing substrate and forming an image on the front side of the printing substrate; subsequently conveying the printing substrate onto a heated roller having a peripheral surface wherein the rear side of the printing substrate contacts the peripheral surface of the heated roller thereby heating the rear side of the printing substrate and simultaneously rotating the heated roller at a peripheral speed wherein the peripheral speed is independent of the printing speed, further comprising adjusting the peripheral speed as a function of the heating of the front side of said printing substrate.

2. A thermal printing process for making transparent prints comprising: supporting a printing substrate having a front side and a rear side on a rotatable print drum such that the rear side contacts the rotatable print drum; thermal printing on the front side of the printing substrate by rotating the rotatable print drum at a printing speed while image-wise energizing a thermal print head thereby heating the front side of the printing substrate and forming an image on the front side of the printing substrate; subsequently conveying the printing substrate onto a heated roller having a peripheral surface wherein the rear side of the printing substrate contacts the peripheral surface of the heated roller thereby heating the rear side of the printing substrate and simultaneously rotating the heated roller at a peripheral speed wherein the peripheral speed is independent of the printing speed, further comprising adjusting the heating of the rear side of the printing substrate as a function of the heating of its front side.

* * * * *